United States Patent [19]

Fenrich

[11] Patent Number: 4,687,449

[45] Date of Patent: Aug. 18, 1987

[54] STAGED HYDRAULIC TRIM-TILT SYSTEM

[75] Inventor: William G. Fenrich, Oshkosh, Wis.

[73] Assignee: Brunswick Corporation, Skokie, Ill.

[21] Appl. No.: 811,582

[22] Filed: Dec. 20, 1985

[51] Int. Cl.[4] ..... B63H 5/12

[52] U.S. Cl. ..... 440/61; 91/399; 91/189 R; 91/401; 440/53

[58] Field of Search ..... 440/53, 52, 61, 63, 440/56; 91/401, 399, 402, 189 R, 25

[56] References Cited

U.S. PATENT DOCUMENTS 4,064,824 12/1977 Hall et al. ..... 440/61
4,308,018 12/1981 Nakamura et al. ..... 440/61
4,391,592 7/1983 Hundertmark ..... 440/61
4,490,120 12/1984 Hundertmark ..... 440/61

*Primary Examiner*—Joseph F. Peters, Jr.
*Assistant Examiner*—Edwin L. Swinehart
*Attorney, Agent, or Firm*—O. T. Sessions

[57] ABSTRACT

A hydraulic trim-tilt system for an outboard motor (10) utilizes a first pilot operated relief valve (48) in one trim piston (21) to limit the stroke of the trim pistons (21, 22) under load. After the trim pistons have reached the top of their stroke, under reduced load, the first pilot operated relief valve (48) is blocked and a second pilot operated relief valve (58) operates to allow a higher pressure to be supplied to the trim-tilt unit (16) to lift the outboard propulsion unit (15) in a higher shallow water drive range.

6 Claims, 5 Drawing Figures

STAGED HYDRAULIC TRIM-TILT SYSTEM

TECHNICAL FIELD

This invention relates to outboard propulsion units for water craft and particularly for hydraulic devices for trimming and tilting outboard propulsion units.

BACKGROUND ART

The hydraulic trim-tilt system disclosed in U.S. Pat. No. 4,391,592 and No. 4,490,120, both to Hundertmark, provide trim-tilt systems for outboard propulsion units which use a pilot valve and a trim piston to provide different operating pressures for the tilt and trim ranges of operation. The prior systems would allow the trim angle to be changed under power but prevented the engine from being tilted above the trim range while under power. These systems would also prevent operation of the motor in a shallow water tilt mode, that is, at a tilt angle above the normal trim range but with the propeller still in the water. This shallow water operation is occasionally desirable when operating in shallow water or beaching a boat. The prior device could be raised to the shallow water tilt range by cutting the power and raising the motor to the desired tilt angle, but the propulsion unit would rapidly tilt down if engine power was applied.

DISCLOSURE OF THE INVENTION

It is an object of the present invention to provide a hydraulic system for trimming and tilting an outboard propulsion unit such as an outboard motor which will allow the outboard motor to be operated in a shallow water tilt mode above the normal trim angle range, while preventing the inadvertent tilting of the propulsion unit above the normal trim range while under power.

The foregoing objective, among others, is achieved in a hydraulic system for trimming and tilting an outboard propulsion unit pivotally mounted on a support member for mounting on a boat. The hydraulic system includes a first extensible hydraulic tilt piston-cylinder unit pivotally connected to the propulsion unit and to the support member and an extensible hydraulic trim piston-cylinder means connected to one of the propulsion unit and the support member and having an extensible part for engaging the other of the propulsion unit and the support member. A reversible hydraulic pump is hydraulically connected by conduit to the tilt unit and the trim means to supply the tilt unit and trim means with hydraulic fluid to raise and lower the propulsion unit. A pressure relief means is provided to limit the pressure of the hydraulic fluid to a first predetermined level when the trim means is extended a first predetermined distance and to limit the pressure of the hydraulic fluid to a second predetermined level when the trim means is extended a second predetermined distance greater than the first distance.

Preferably the second predetermined pressure level is greater than the first predetermined pressure level.

The pressure relief means can include a first relief valve means to provide the first predetermined pressure level and a second relief valve means to provide the second predetermined pressure level. Both the first and second relief valve means can be mounted in pistons of the trim piston-cylinder means.

The first relief valve means can include a first relief valve through a trim piston, a first pilot operated check valve to prevent flow through the first relief valve except when the trim means is extended a distance equal to or greater than the first predetermined distance, and a blocking means to prevent flow through the first relief valve when the trim means is extended the second predetermined distance. Preferably the blocking means is fixed to a cylinder of the trim piston-cylinder means and blocks flow through the pilot operated check valve when the trim means is fully extended. The first pilot operated check valve can include a valve stem projecting from the piston in which the valve is mounted to engage a portion of the corresponding cylinder when the trim means is extended the first predetermined distance.

In the preferred embodiment, the second relief valve means would also include a second relief valve through the piston and a second pilot operated check valve to prevent flow through the second relief valve except when the trim means is extended the second predetermined distance. The second relief valve means could also include a passage in the piston in which the valve is mounted to prevent blockage of flow through the relief valve means by the corresponding cylinder when the trim means is fully extended.

BEST MODE FOR CARRYING OUT THE INVENTION

Figure 2:
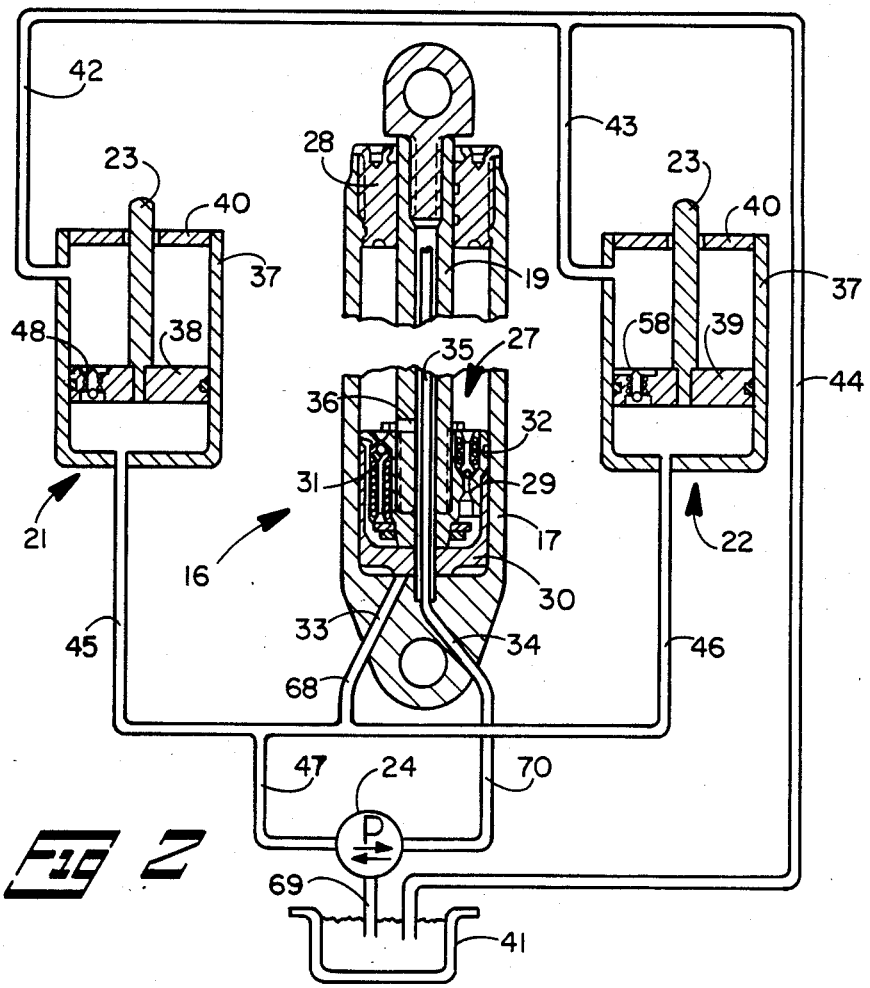
FIG. 2 is a schematic view of the hydraulic system incorporated in the outboard motor of FIG. 1.

The outboard motor 10 shown in the figures includes a transom bracket 11 for attachment to the transom 12 of a boat. A swivel bracket 13 is mounted on the transoom bracket 11 by a tilt pin 14 for tilting movement and the outboard drive unit 15, shown in phantom lines in FIG. 1, is pivotally mounted in a conventional manner on the swivel bracket 13 to provide steering control about a generally vertical steering axis.

A hydraulic trim-tilt system is provided for trimming and tilting the outboard drive unit 15 and for absorbing shock in the event of collision with an underwater obstacle. The hydraulic system includes a trim-tilt hydraulic piston-cylinder unit 16 having its cylinder 17 pivotally connected at its lower end to the transom bracket 11 by a pin 18 and having its piston rod 19 pivotally connected to the swivel bracket 13 by another pin 20. Two hydraulic trim piston-cylinder units 21 and 22 are mounted on the transom bracket 11, one on each side of the trim-tilt unit 16, with their piston rods 23 extending to the rear and upward. An electrically operated reversible hydraulic pump unit 24 is mounted in the transom bracket 11 above one of the trim units 22 and includes a spool valve, not illustrated, which is connected to drive the hydraulic piston-cylinder units 16, 21, and 22 and hydraulically lock their pistons in place when the pump 24 is not operating.

Figure 1:
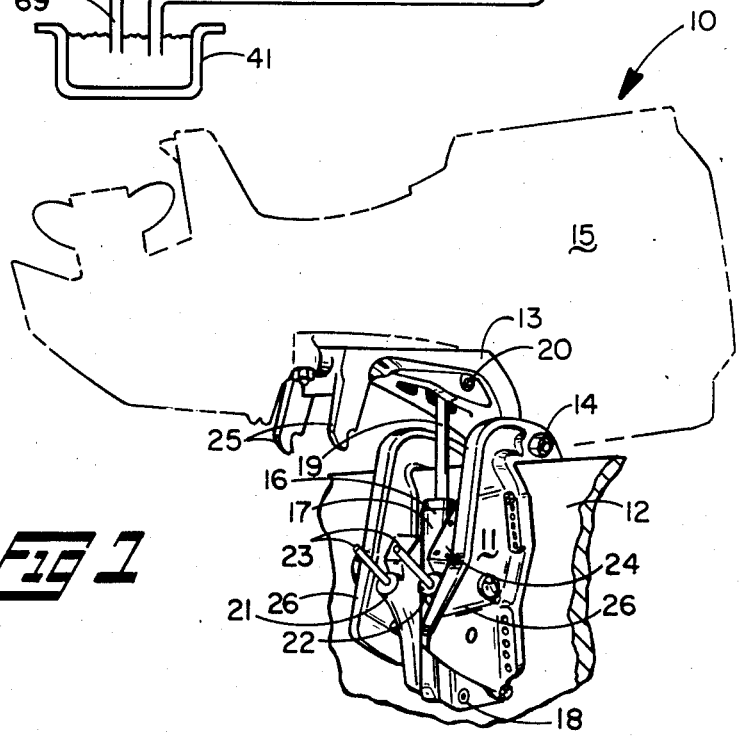
FIG. 1 is a perspective view showing an outboard motor incorporating the features of the invention.

In the full tilt position shown in FIG. 1 the outboard drive unit 15 is supported solely by the fully extended trim-tilt piston-cylinder unit 16, while over the range of trim positions the drive unit 15 is supported by the two trim piston rods 23 abutting against the swivel bracket 13, as well as by the trim tilt unit. During the full range of trim operation, that is while the drive unit 15 is supported by the two trim piston rods 23, the two arms 25 extending forward from the swivel bracket 13 are positioned inside and adjacent to the two wings 26 of the transom bracket 11 to provide lateral support for the outboard drive unit 15. A shallow water drive range of operation is defined as the angular positions of the outboard drive unit 15 wherein the two arms 25 of the swivel bracket 13 are above the wings 26 of the transom bracket 11 so that no lateral support is provided by the wings 26 while the propeller is still submerged or partially submerged in the water.

The trim-tilt piston-cylinder unit 16 shown in FIG. 2 is similar to those shown in FIGS. 9, 10, and 11 of U.S. Pat. No. 4,052,952. The unit includes a cylinder 17 which receives a piston assembly 27, a cylinder end cap 28, and a piston rod 19 extending through the cylinder end cap 28. The piston assembly 27 includes a shock piston 29 attached to the piston rod 19 and a floating trim piston 30. The shock piston 29 includes a spring loaded ball shock valve 31 to allow flow through the shock piston 29 in response to the shock loading on the piston rod 19 should the lower portion of the outboard drive unit 15 strike an object underwater. Thus under a shock load the drive unit 15 will tilt up, extending the piston rod 19 and pulling the shock piston 29 away from the floating trim piston 30. A spring loaded ball return valve 32 in the shock piston 29 allows the outboard drive unit 15 to gently return to its lower position when the shock load has passed. A first inlet 33 is provided to supply hydraulic fluid below the piston assembly 27 and a second inlet 34 is provided to supply hydraulic fluid above the piston assembly 27. The second inlet 34 is connected to the chamber above the piston assembly 27 by a tube 35 telescoped into the tubular piston rod 19 and a hole 36 in the side of the piston rod 19 near the top of the shock piston 29.

Figure 3:
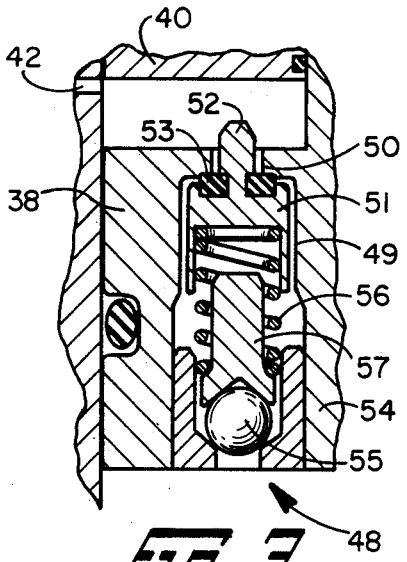
FIG. 3 is an enlarged view of one of the pilot operated check valve incorporated in the outboard motor of FIGS. 1 and 2.

The trim piston-cylinder assemblies 21 and 22 include closed cylinders 37 mounted in the transom bracket 11, pistons 38 and 39 mounted in the cylinders 37, and piston rods 23 extending through the cylinder caps 40. The cylinders 37 are connected above the pistons 38 and 39 to the sump 41 by passageways 42, 43, and 44. Below the trim pistons 38 and 39 the cylinders 37 are connected by passageways 45, 46, and 47 to the pump unit 24. One of the pistons 38 includes a first pilot operated relief valve 48 which acts to limit the maximum pressure below the pistons 38, 39, and 27 in both the trim units 21 and 22 and trim-tilt unit 16 as the trim pistons 38 and 39 approach the top of their stroke. This first pilot operated relief valve 48 is most clearly illustrated in FIG. 3 and includes a bore 49 through the piston 38. A restriction 50 at the top of the bore 49 provides a valve seat for the pilot valve member 51 which has a stem 52 projecting through the restriction 50 and a valve seal 53 surrounding the stem 52. A valve seat member 54 for the ball relief valve 55 is threadedly engaged in the lower end of the bore 49 and a single coil spring 56 biases both the ball valve member 55 and the pilot valve member 51 toward their closed positions. A spring guide member 57 is provided between the ball valve member 55 and the spring 56 to position the spring 56. The cylinder cap 40 acts to block fluid communication between the first pilot operated relief valve 48 and the outlet passageway 42 from the trim unit 21 when the trim piston rod 23 is fully extended. The pilot valve stem 52 should project above the trim piston 38 sufficiently to fully open the pilot valve well before the trim piston 38 reaches the top of its stroke and blocks communication with the outlet 42. The spring 56 should be sized to establish a first predetermined pressure level low enough to prevent the trim pistons 38 and 39 from fully extending when the outboard propulsion unit 15 is producing significant forward thrust.

Figure 4:
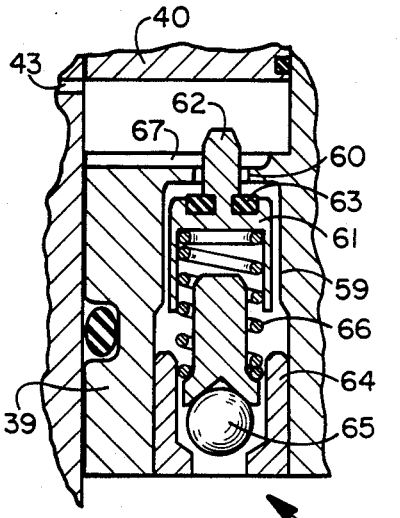
FIG. 4 is an enlarged view illustrating another pilot operated check valve also incorporated in the outboard motor of FIGS. 1 and 2.
Figure 5:
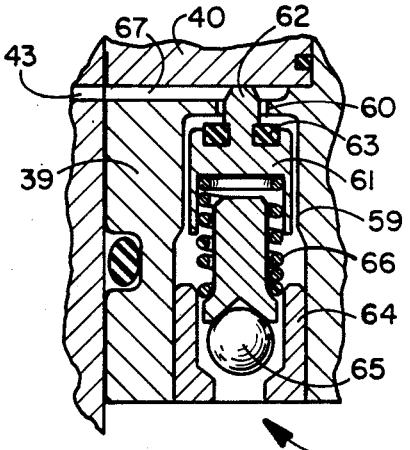
FIG. 5 is a view of the valve of FIG. 4 showing the valve in an open position.

The other trim piston 39 includes a second pilot operated relief valve 58 which acts to limit the maximum pressure below the pistons 38, 39, and 27 in both the trim units 21 and 22 and the trim-tilt unit 16 after the trim pistons 38 and 39 have reached the top of their stroke and flow through the first pilot operated relief valve 48 is blocked by the cylinder cap 40. The second pilot operated relief valve 58 is most clearly shown in FIG. 4 and includes a bore 59 through the trim piston 39. Like the first pilot operated relief valve 48, a restriction 60 at the top of the bore 59 provides a valve seat for the pilot valve member 61 which has a stem 62 projecting through the restriction 60 and a valve seal 63 surrounding the stem 62. A valve seat member 64 for the ball relief valve 65 is threadedly engaged in the lower end of the bore 59 and a single coil spring 66, stronger than the spring 56 in the first pilot operated relief valve 48, biases both the ball valve member 65 and the pilot valve member 61 toward their closed positions. A groove 67 in the top of the trim piston 39 provides fluid communication between the valve bore 59 and the outlet passageway 43 when the trim piston 39 is at the top of its stroke. Thus when the trim pistons 38 and 39 have reached the top of their strokes and communication between the valve bore 49 of the first pilot operated relief valve 48 and the outlet passageway 42 is blocked, the second pilot operated relief valve 58 will provide for a second predetermined pressure level below the trim and trim-tilt pistons 38, 39 and 27 greater than that provided by the first pilot operated relief valve 48.

OPERATION

In operation, with the trim pistons 38 and 39 and the trim-tilt piston 27 in their lower positions, the outboard propulsion unit 15 may be trimmed out, i.e. up, by turning on the electric motor driven pump 24 to supply fluid to the trim-tilt and trim units 16, 21, and 22 by means of the fluid passages 45, 46, 47, and 68, thereby raising the pistons 27, 38, and 39. The hydraulic fluid above the trim pistons 38 and 39 will return to the sump 41 by way of the fluid passageways 42, 43, and 44 and the additional fluid required by the pump 24 will be made up by flow from the sump through the make-up passage 69.

As the trim pistons 38 and 39 near the top of their stroke, the first pilot operated valve member 48 will open, thereby limiting the maximum pressure of the fluid supplied to the trim and trim-tilt piston-cylinder units 21, 22, and 16. This will prevent the trim pistons 38 and 39 from reaching the top of their stroke when the outboard propulsion unit 15 is producing any significant thrust, thereby preventing tilting of the outboard propulsion unit 15 beyond the trim range. If the outboard propulsion unit 15 is not producing significant thrust, the trim pistons 38 and 39 will be able to reach the top of their strokes thus blocking flow through the first pilot operated relief valve 48 and allowing the second pilot operated relief valve 58 to control the pressure beneath the piston 27 of the trim-tilt unit 16. The spring 66 in the second pilot operated relief valve 58 should be sized to produce a significantly higher maximum pressure than does the first pilot operated relief valve 48. This pressure level should be high enough to support the propulsion unit 15 while it is producing moderate thrust in the shallow water tilt range, but low enough to allow the unit 15 to be forced down should the engine produce higher thrust requiring the lateral support of the swivel bracket arms 25 and transom bracket wings 26.

To tilt the drive unit 15 down, the electric motor driven pump 24 is reversed to supply fluid to the passage 70 connected to the top of the trim-tilt unit 16, thus driving the trim-tilt piston 27 downward. The trim-tilt piston 27 will drive the outboard propulsion unit 15 downwardly until it reaches the trim piston rods 23. At this point the trim-tilt piston 27 will continue to drive the propulsion unit 15 down and drive the trim pistons 38 and 39 downward. The excess fluid beneath the trim pistons 38 and 39 will return to the sump 41 from the pump 24 through the make-up line 69. The additional fluid required on top of the trim pistons 38 and 39 will be made up through the fluid lines 42, 43, and 44 connecting the sump 41 to the upper ports in the trim units 21 and 22.

The invention thus provides a trim-tilt system which operates with the full pressure output of the pump 41 in the trim range of operation, limits the working pressure to a first relatively low pressure near the upper end of the trim range, and provides an intermediate pressure for operation in the tilt range.

We claim:

1. A hydraulic system for trimming and tilting an outboard propulsion unit pivotally mounted on a support member for mounting on a boat, said hydraulic system comprising:

(A) a first extensible hydraulic tilt piston-cylinder unit pivotally connected to said propulsion unit and to said support member;

(B) an extensible hydraulic trim piston-cylinder means separate from said first piston-cylinder unit and connected to one of said propulsion unit and said support member and having an extensible part for engaging the other of said propulsion unit and said support member;

(C) a reversible hydraulic pump means;

(D) a conduit means hydraulically connecting said tilt unit and said trim means to said hydraulic pump to supply said tilt unit and said trim means with hydraulic fluid to raise and lower said propulsion unit;

(E) a first pressure relief means to limit the maximum pressure of said hydraulic fluid supplid to said tilt piston-cylinder unit and said trim piston-cylinder means to a first predetermined level only when said trim piston-cylinder means has partially extended into a range between a first predetermined distance and a second predetermined distance greater than said first predetermined distance; and (F) a second pressure relief means to limit the maximum pressure of the hydraulic fluid supplied to said tilt piston-cylinder unit to a second predetermined level greater than said first predetermined level only when said trim piston-cylinder means has extended at least said second predetermined distance.

2. A hydraulic system for trimming and tilting an outboard propulsion unit pivotally mounted on a support member for mounting on a boat, said hydraulic system comprising:

(A) a first extensible hydraulic tilt piston-cylinder unit pivotally connected to said propulsion unit and to said support member;

(B) an extensible hydraulic trim piston-cylinder means connected to one of said propulsion unit and said support member and having an extensible part for engaging the other of said propulsion unit and said support member;

(C) a reversible hydraulic pump means;

(D) a conduit means hydraulically connecting said tilt unit and said trim means to said hydraulic pump to supply said tilt unit and said trim means with hydraulic fluid to raise and lower said propulsion unit;

(E) a first pressure relief means to limit the maximum pressure of said hydraulic fluid supplied to said tilt piston-cylinder unit and said trim piston-cylinder means to a first predetermined level only when said trim piston-cylinder means has partially extended into a range between a first predetermined distance and a second predetermined distance greater than said first predetermined distance, said first relief means including a first relief valve through a piston of said trim piston-cylinder means, a first pilot operated check valve to prevent flow through said first relief valve except when said trim means is extended a distance equal to or greater than said first predetermined distance, and a blocking means to prevent flow through said first relief valve when said trim means is extended said second predetermined distance; and (F) a second pressure relief means to limit the maximum pressure of the hydraulic fluid supplied to said tilt piston-cylinder unit to a second predetermined level greater than said first predetermined level only when said trim piston-cylinder means has extended at least said second predetermined distance.

3. The hydraulic system defined in claim 2 wherein said blocking means is fixed to a cylinder of said trim piston-cylinder means and blocks flow through said pilot operated check valve when said trim means is fully extended.

4. The hydraulic system defined in claim 3 wherein said first pilot operated check valve includes a valve stem projecting from the piston in which said first relief valve means is mounted to engage a portion of the corresponding cylinder when said trim means is extended said first predetermined distance.

5. The hydraulic system defined in claim 2 wherein said second relief means includes a second relief valve through a piston of said trim piston-cylinder means, and a second pilot operated check valve to prevent flow through said second relief valve except when said trim means has extended at least said second predetermined distance.

6. The hydraulic system defined in claim 5 wherein said second relief valve means further includes a passage in the piston in which said second relief valve means is mounted to prevent blockage of flow through said relief valve means by the corresponding cylinder when said trim means is fully extended.

* * * * *